United States Patent [19]

Aubert et al.

[11] Patent Number: 4,550,586

[45] Date of Patent: Nov. 5, 1985

[54] DEVICE FOR FORMING PART OF A PRESS BRAKE FOR DETERMINING AUTOMATICALLY THE THICKNESS OF THE SHEET

[75] Inventors: Jean-Daniel Aubert, Le Mont s/Lausanne; André Fornerod, Giez s/Yverdon, both of Switzerland

[73] Assignee: Cybelec S.A., Renens, Switzerland

[21] Appl. No.: 547,641

[22] Filed: Nov. 1, 1983

[30] Foreign Application Priority Data

Nov. 5, 1982 [CH] Switzerland ..... 6440/82

[51] Int. Cl.[4] ..... B21D 9/05

[52] U.S. Cl. ..... 72/389; 72/21

[58] Field of Search ..... 72/389, 16, 26, 21, 72/22, 7, 34, 33, 441

[56] References Cited

U.S. PATENT DOCUMENTS 3,440,847 4/1969 Giordano ..... 72/26

FOREIGN PATENT DOCUMENTS 2041802 9/1980 United Kingdom ..... 72/16

*Primary Examiner*—Francis S. Husar
*Assistant Examiner*—Linda McLaughlin
*Attorney, Agent, or Firm*—Kimmel, Crowell & Weaver

[57] ABSTRACT

The device employs a number of detectors (1) mounted at the level of the upper surface of the die (2) and a numerical control system (5). The purpose of the detectors is to signal to the numerical control the moment that the part b of the sheet begins to rise. The device allows the automatic determination of the thickness of the sheet in the area where the bend is to be located, during the course of the forming operation. The thickness of the sheet is then used by a numerical control system to correct the travel of the tool, without interrupting the forming cycle, in such a way as to obtain with high precision the required bend angle.

7 Claims, 3 Drawing Figures

Figure 1:
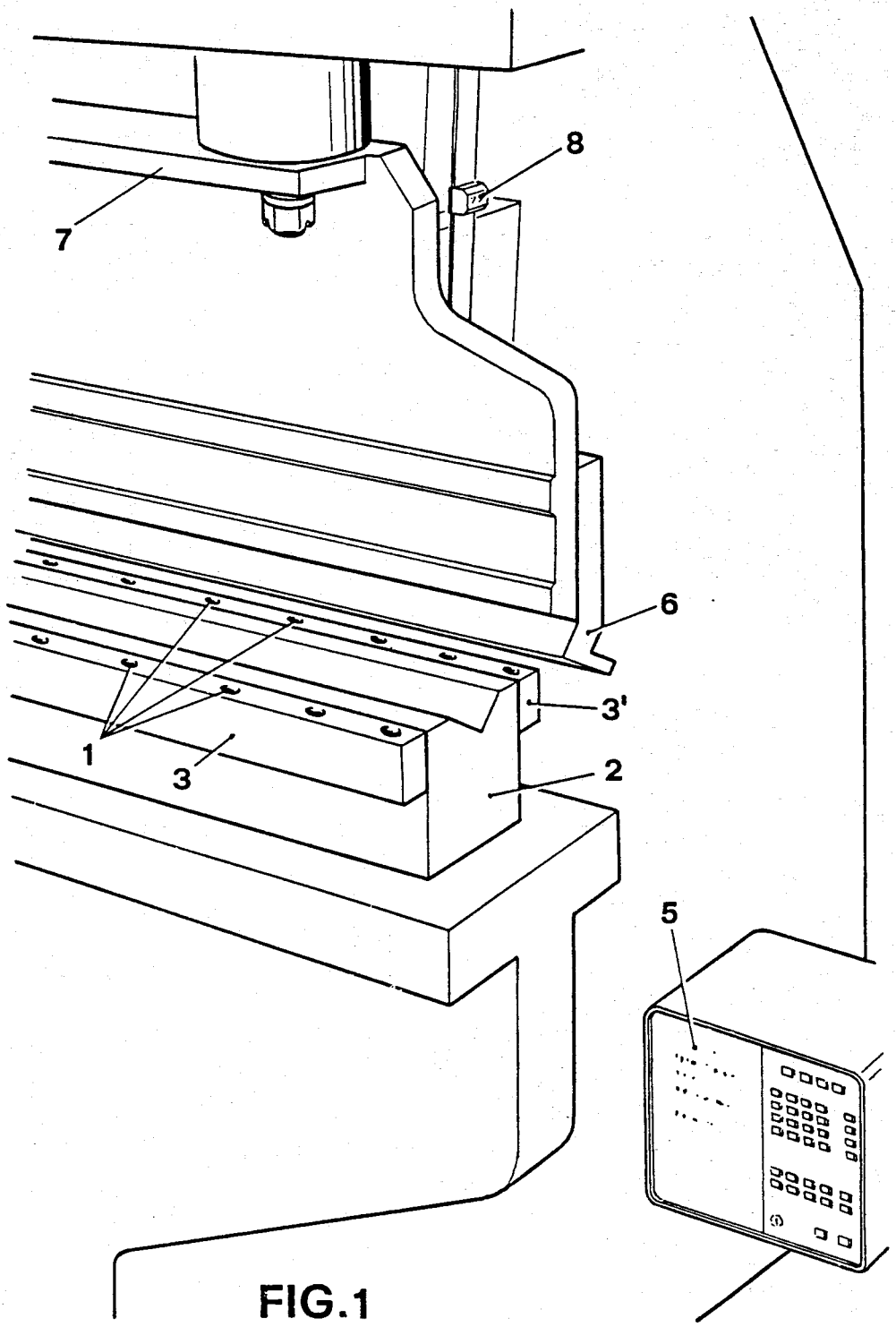

DEVICE FOR FORMING PART OF A PRESS BRAKE FOR DETERMINING AUTOMATICALLY THE THICKNESS OF THE SHEET

In the operation of forming a sheet on a press brake, the accuracy of the angle obtained depends not only on the precision of the machine, but also on that of the sheet being formed. Even though modern press brakes are very highly developed and capable of working to great accuracy, the thickness of the sheet can vary considerably from the nominal dimension.

It is common to find that sheets of the same size, even when originating in the same batch, possess different thicknesses as a result of the manufacturing tolerances applied. These thickness variations, which can be as high as 10% between any two sheets, may also occur between different points on the same sheet. In addition, the sheets may be corrugated or curved due to the conditions of storage.

To produce a given angle of bend, the travel of the press brake tool must be set according to the thickness of the sheet. If the tool travel were set simply to correspond with the mean thickness of a batch of sheets, the bend angle obtained would vary considerably from sheet to sheet, in most cases unacceptably. It is thus necessary, to assure constant accuracy of the bend angle, to measure the thickness of each sheet very accurately, before carrying out the forming operation. Conventional procedures require the operator first to measure the sheet thickness with a suitable instrument, and then to set the tool travel correspondingly. The time taken up by this method considerably increases the duration of the sheet forming cycle. If it is desired to avoid lengthening this procedure, some method of automating the measurement of the sheet thickness must be adopted. One possible method would be to detect the exact moment at which the tool touches the sheet and, by instantaneously measuring the distance between the tip of the tool and the upper surface of the die at this moment, to determine the thickness of the sheet. This method presents a number of disadvantages, for example the need to reduce the speed of the tool as it approaches the sheet, and the temporary stopping of the tool as contact is made.

The problems described above are resolved much more simply and with high accuracy, by means of the present invention.

The objective of the invention is to determine automatically the thickness of the sheet during the course of the forming cycle itself, and to modify immediately the travel of the tool correspondingly, in order to obtain the required bend angle. Without interrupting the forming cycle or lengthening its duration therefore, the invention described will determine the thickness of the sheet, transmit this value to a control centre which compares the true thickness with the programmed thickness, and use this information to modify the travel of the tool before completion of the press stroke.

The present invention thus concerns device forming part of a press brake for determining automatically the thickness of the sheet, comprising at least one detector (1) located at the level of the upper surface of the die and at least one lineal digital transducer at the end of the press brake beam.

The advantages of the device deriving from the present invention are, compared with existing devices, self-evident. The control centre knows exactly the thickness of the sheet in the area where the bend is to be located. During a time which is much shorter than that of the travel of the tool, the control centre determines the length of travel necessary to produce the required bend angle, and arrests the tool at the limit of this travel, without any action on the part of the operator. The procedure even reduces very considerably the influences of any variations in the thickness of a sheet at different points, and of any corrugations or other faults.

Figure 2:
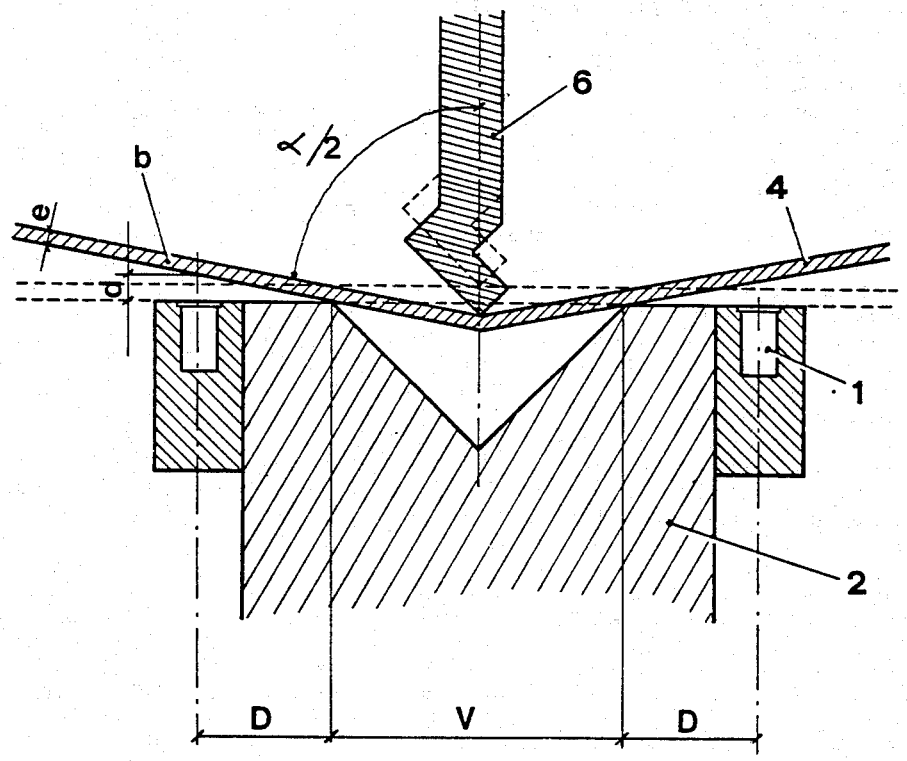

The description which follows, given as an example, will aid a fuller understanding of the principle of the invention. The accompanying illustrations show, respectively:

FIG. 1 a partial perspective view of a press brake fitted with the equipment corresponding to the invention, FIG. 2 a cross-sectional view drawn through the tool, the sheet and the die.

Figure 3:
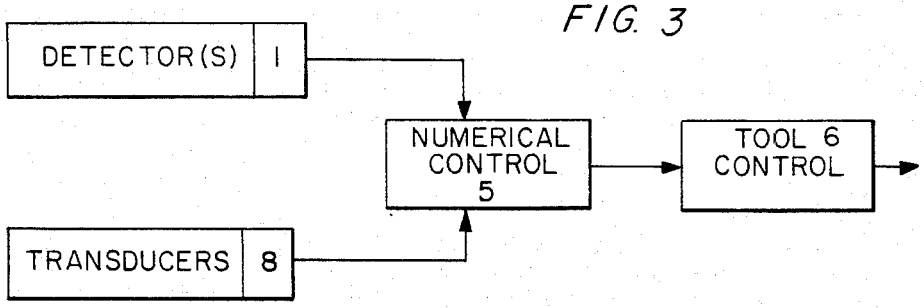

FIG. 3 a block diagram showing the interrelationship of the control for the forming tool, and the imputs thereto from the detectors and transducers.

The term "sheet" used throughout the present document is understood to mean, in the widest sense, the material to be formed on the press brake, whatever its substance.

Referring to the drawings, an example of the device according to the invention comprises the detectors 1 positioned at the level of the upper surface of the die 2. The detectors are housed either in the die itself or, preferably, in the bar 3 which is fixed to the die such that the detectors are on the level of the upper surface of the die. In FIGS. 1 and 2 two such bars, 3 and 3' are shown, one on each side of the die, but it should be noted that the device will function satisfactorily with a bar on one side only. These detectors serve to signal the moment that the contact between the sheet and the die is broken as the sheet 4 begins to rise. The signals from the detectors are transmitted to a numerical control system 5 which is programmed to determine, in a very short time, the value $\Delta D$ of the correction to be applied to the travel of the tool 6 according to the difference between the actual thickness of the sheet as measured by the device, and the thickness initially programmed. The functioning of the device will now be described. The measurement zone comprised by the detectors 1 is activated when the tip of the tool reaches a distance from the upper surface of the die which is equal to twice the programmed thickness of the sheet. The sheet 4 covers a number of detectors 1 which varies according to the sheet dimensions, and these become operative when the measurement zone is activated. The pressure of the tool on the sheet causes part b of the sheet to begin to rise, but the detectors do not signal this immediately, because they possess a certain sensitive distance d, which differs from one type of detector to another. The detectors must therefore be calibrated, but this process is very simple and consists of a single operation. By performing a bending operation on a sheet of known thickness, the numerical control system is informed, when in the corresponding program mode, of the exact value of this distance d. For sheets of all thicknesses, this value remains identical, provided that all sheets are of the same material.

The signal from the first detector to be triggered by the sheet reaching the limit of its sensitive distance d, measured along the axis of the detector, instructs the numerical control 5 to distinguish between, and memorize, the detectors covered by the sheet and those left inoperative. When half the number of these detectors have transmitted the signal indicating that the distance d has been reached, the numerical control memorizes the position of the beam 7 of the press brake, and thus the position of the tip of the tool. This position is defined by the signals from two linear digital transducers 8, one of which is not shown, which are located at each end respectively of the beam. As the transducers are accurate only to 0.01 mm and cannot be assumed to be set exactly in every case, the numerical control is programmed to memorize only the lowest of the possible two positions signalled. The system may also be programmed to memorize the mean of the two values, or even a value corresponding to a given relationship between the two. The magnitude of the difference between the actual sheet thickness and the programmed thickness is given by the following expression:

$$\Delta e = Y + \frac{V \cdot d}{2 \cdot D} - Y\text{ref} - ep$$

where

Y=the position of the tool indicated by the linear digital transducers

Yref=the vertical coordinate of the position of the upper surface of the die

V=the width across the die vee-groove

D=the distance between the axis of a detector and the edge of the die vee-groove ep=the programmed sheet thickness d=the sensitive distance of the detectors.

The correction ΔY to be applied to the tool travel is determined automatically by the numerical control. It may be calculated from the following formula:

$$\Delta Y = \Delta e \cdot \{4.4 \cdot 10^{-5} \cdot (180 - \alpha) + 1\}$$

where $\alpha$ is the bend angle required.

After determining the required correction value, the numerical control operates automatically to modify the tool travel accordingly.

The detectors adopted for the device may be of any type: proximity or contact, inductive, capacitive, laser, ultrasonic, etc.

As the tool retreats, the usual "spring-back" effect occurs, modifying the final bend angle. For a given material the amount of spring-back can be foreseen with reasonable accuracy and incorporated in the program for the numerical control. However, if detectors with a very wide range of operation are used, for example proportional voltage types, and if these are installed on both sides of the die, the device described is capable of monitoring the bend angle both during forming and after spring-back. For this purpose the numerical control memorizes not only the position of the tool and the true thickness of the sheet, but also the response curve of the detectors, which is incorporated in the program beforehand.

In another variant of the device according to the invention, the vertically mounted detectors are replaced by horizontally mounted photocells positioned at the ends of the die or the bars 3 and 3'. These are aligned with the upper surface of the die: when the sheet is resting on the die the cells are masked, and the appropriate signal is transmitted when the sheet rises to allow the beam to detect the die surface once more.

The above described device according to the invention allows the determination of the thickness of the sheet by measuring the difference between the position of the tip of the tool and that of the upper surface of the die on which the sheet rests. The measurement is performed at the moment that the part b of the sheet begins to rise, i.e. the moment that this part of the sheet is no longer in contact with the upper surface of the die. This value for the true thickness of the sheet is then used by the control centre as a basis for determining the exact distance which the tool must travel in order to obtain the required bend angle.

What we claim is:

1. A process for bending a sheet by means of a press brake, comprising the step of simultaneously determining the thickness of the sheet by measuring the difference between the position of the tip of the forming tool and that of the upper surface of the die, at the moment that the lower surface of the sheet rises from the upper surface of the die, and correcting the travel of the tool according to the determined thickness of the sheet, thus obtaining the required bend angle without any interruption of the forming cycle.

2. A process for bending a sheet by means of a press brake, comprising the step of simultaneously determining the thickness of the sheet by measuring the difference between the position of the tip of the forming tool and that of the upper surface of the die, at the moment that the lower surface of the sheet rises from the upper surface of the die, and adding to the value of this difference the value of the distance travelled by the tip of the forming tool for the first bend of the sheet until the moment that the lower surface of the sheet rises from the upper surface of the die, and correcting the travel of the tool according to the determined thickness, thus obtaining the required bend angle without any interruption of the forming cycle.

3. A process according to claim 2, wherein the position of the forming tool is located by means of at least one lineal digital transducer situated at the end of the press beam, the rise of the sheet being detected by means of at least one detector situated at the level of the upper surface of the die.

4. A process according to claim 2, wherein the position of the forming tool is located by means of at least one lineal digital transducer situated at the end of the press beam, the rise of the sheet being detected by means of at least one detector situated at the level of the upper surface of the die and supported by a bar fixed to the side of the die.

5. A process according to claim 2, wherein the position of the forming tool is located by means of at least one lineal digital transducer situated at the end of the press beam, the rise of the sheet being detected by means of at least two detectors situated at the level of the upper surface of the die, each of said detectors being supported by a bar respectively fixed on both sides of the die.

6. A device forming part of a press brake for determining automatically the thickness of a sheet being formed and for simultaneously correcting the travel of a forming tool operatively connected to a press brake beam, comprising at least one detector located at the level of the upper surface of a die, said die facing said forming tool and cooperating therewith provided to detect the moment that the lower surface of the sheet rises from the upper surface of the die, at least one lineal digital transducer at the end of the press brake beam, a numerical control system operatively connected to the detector and the lineal digital transducer for continuously measuring the difference between the position of the tip of the forming tool located by means of said lineal digital transducer and the position of the upper surface of the die, and for adding the value of this difference to the value of the distance travelled by the tip of the forming tool due to the bend in the sheet until the moment that the lower surface of the sheet rises from the upper surface of the die, and said numerical control system further including means for correcting the travel of the tool according to the determined thickness of the sheet, provided to obtain the required bend angle without any interruption of the forming cycle.

7. A device forming part of a press brake for determining automatically the thickness of a sheet to be formed and for simultaneously correcting the travel of a forming tool operatively connected to a press brake beam, comprising at least two bars fixed on each side of a die, said die facing said forming tool and cooperating therewith at least two detectors, each being supported by one of said bars and being located at the level of the upper surface of the die, and provided to detect the moment that the lower surface of the sheet rises from the upper surface of the die, at least one lineal digital transducer at the end of the press brake beam, said device further including a numerical control system operatively connected to the detector and the lineal digital transducer for continuously measuring the difference between the position of the tip of the forming tool located by means of said lineal digital transducer and the position of the upper surface of the die, and for adding the value of this difference to the value of the distance travelled by the tip of the forming tool due to the bend in the sheet until the moment that the lower surface of the sheet rises from the upper surface of the die, and means with said numerical control system for correcting the travel of the tool according to the determined thickness of the sheet, provided to obtain the required bend angle without any interruption of the forming cycle.

* * * * *